United States Patent [19]

Matsui et al.

[11] 4,414,798

[45] Nov. 15, 1983

[54] SPLICING APPARATUS FOR SPUN YARNS

[75] Inventors: Isamu Matsui, Kyoto; Hiroshi Mima, Joyo, both of Japan

[73] Assignee: Murata Kikai Kabushiki Kaisha, Kyoto, Japan

[21] Appl. No.: 359,041

[22] Filed: Mar. 17, 1982

[30] Foreign Application Priority Data

Mar. 18, 1981 [JP] Japan ..... 56-40033

[51] Int. Cl.[3] ..... D01H 15/00

[52] U.S. Cl. ..... 57/22; 57/261

[58] Field of Search ..... 57/22, 23, 261

[56] References Cited

U.S. PATENT DOCUMENTS 4,217,749 8/1980 Rohner et al. ..... 57/261
4,246,744 1/1981 Matsui et al. ..... 57/22
4,263,775 4/1981 Mima ..... 57/22
4,322,943 4/1982 Rohner et al. ..... 57/22 X
4,344,277 8/1982 Rohner et al. ..... 57/22

*Primary Examiner*—Donald Watkins
*Attorney, Agent, or Firm*—Spensley, Horn, Jubas & Lubitz

[57] ABSTRACT

A splicing apparatus for spun yarns comprises a splicing member which has a cylindrical splicing hole, a slit for insertion of the yarns and a jet nozzle jetting a compressed fluid and opened to the splicing hole in the tangential directions, and yarn end control nozzles, yarn cutting devices, a yarn guiding means and yarn clamping devices, which are arranged in sequence on both sides of the splicing member. Control plates for covering the opening of the splicing hole partially is arranged on both the sides of the splicing member to control the quantity of the fluid flowed out from the opening of the splicing hole.

6 Claims, 30 Drawing Figures

SPLICING APPARATUS FOR SPUN YARNS

BACKGROUND OF THE INVENTION

In the splicing apparatus in which a compressed fluid is jetted to lapped yarn ends to effect splicing of yarns, two yarn ends are inserted in a splicing hole and compressed air is jetted in the splicing hole, whereby the lapped portion of the two yarn ends is turned and the yarn ends are entangled with each other to effect splicing of the yarn ends. The lapped portion of both the yarn ends is clamped at two positions and both the two yarn ends are simultaneously clamped in this state. If this lapped portion of both the yarn ends of specific sizes which are combined along a specific section is turned, fibers of the two yarn ends between the two clamping points are false-twisted and entangled, but the top portions of the yarn ends at the clamping points are not thus entangled but are left in the form of horny projections. At the subsequent weaving or knitting step, such horny projections are caught by a knitting needle or the like and there is a risk of breakage causing degradation of the quality of a woven or knitted fabric.

As means for preventing formation of horny projections, there may be considered a method in which yarn ends are clamped at a position apart by a certain distance from the top portions to keep the top portions free, both the yarn ends are lapped together in this state and the lapped portion is turned, whereby formation of a horny projection due to entanglement of both the yarn ends can be prevented. However, in this case, since the top portion of the yarn end is kept free, the yarn end is let to fly out from the splicing hole by streams of jetted air flowing from both the end openings of the splicing hole, and therefore, splicing becomes impossible. We previously proposed a splicing apparatus in which a fluid restriction or mechanical restriction is given to the free top portions of both the yarn ends to gurantee the initial entanglement of both the yarn ends, whereby a good joint is obtained. According to this proposal, both the yarn ends are inserted into suction nozzles on both the outer sides of the splicing hole and in the state where a restriction is given to each yarn end by the sucking force of the suction nozzle, compressed air is jetted to the lapped portion of both the yarn ends. In this splicing apparatus, however, free turning of the top portion of the yarn end is often inhibited by the sucking force, and there is a possibility of formation of a horny projection in the lapped portion.

Furthermore, in order to turn the lapped portion in the splicing hole in the state where the above-mentioned sucking force is applied to the top portions of both the yarn ends, it is necessary to cause a much stronger turning air stream capable of overcoming the resistance by the sucking force to act on the lapped portion, as compared with the case where the top portions of both the yarn ends are kept free. By this strong turning force, the lapped portion is readily excessively turned and one yarn is turned in the untwisting direction, and therefore, yarn breakage is sometimes caused.

SUMMARY OF THE INVENTION

The present invention relates to a splicing apparatus in which a compressed fluid is jetted to lapped yarn ends to effect splicing of yarns.

A primary object of the present invention is to provide a splicing apparatus in which both the yarn ends to be spliced are clamped at a position apart by a specific distance from the top portions of the yarn ends in the state where the lapped top portions of both the yarn ends are kept untwisted and a compressed fluid is applied to the lapped portion of both the yarn ends while keeping the top portions of both the yarn ends free, whereby splicing can be accomplished without the foregoing disadvantages.

More specifically, the object of the present invention is to provide splicing apparatus for spun yarns, which comprises a splicing member having a splicing hole and a jet nozzle for jetting a compressed fluid into said splicing hole, control plates located on both the outer sides of the splicing hole of the splicing member at such positions that certain side edges of the control plates traverse a part of the opening of the splicing hole, and a swingable yarn pressing lever arranged on the outer sides of the control plates, said yarn pressing lever having a side edge pressing at least one of two yarns to be spliced together and intersecting the side edges of the control plates. According to this splicing apparatus, positioning of both the free yarn ends is performed by the side edges of the control plates and the side edge of the pressing lever intersecting the side edges of the control plates to guarantee initial entanglement of both the yarn ends and to prevent fly-out of the yarn or propagation of untwisting, whereby splicing can be accomplished without formation of a horny projection or deviation of the yarn quanity of the spliced portion among spindles.

According to the present invention, there are disposed control plates on both the outer sides of the splicing hole of the splicing member at such positions that specific side edges of the splicing plates traverse a part of the opening of the splicing hole, and a turnable yarn pressing lever for pressing at least one of yarns to be spliced is arranged on the outer sides of said control plates. By dint of this structural feature, according to the present invention, in the state where both the yarn ends are set within the splicing hole, both the yarn ends can be positioned so that they are brought in contact with each other, and therefore, entanglement of fibers of the yarn ends can be promoted prior to the turning movement of the yarn ends and both the yarn ends can be prevented from being turned in the state where both the yarn ends are separated from each other. Furthermore, since the stream of the fluid flowing out from both the openings of the splicing hole 37, that is, the stream of the fluid flowing in the direction of the central line of the splicing hole 37, is controlled by the control plates, both the yarn ends in the free state can be prevented from flying out from the splicing hole.

Moreover, when the entangled and integrated yarn ends are turned, yarn breakage due to untwisting can be prevented by the yarn pressing device arranged on the outer sides of the control plates, and the splicing operation can be accomplished assuredly without splicing failure.

DETAILED DESCRIPTION OF THE INVENTION

The present invention will now be described in detail with reference to embodiments illustrated in the accompanying drawings.

Figure 1:
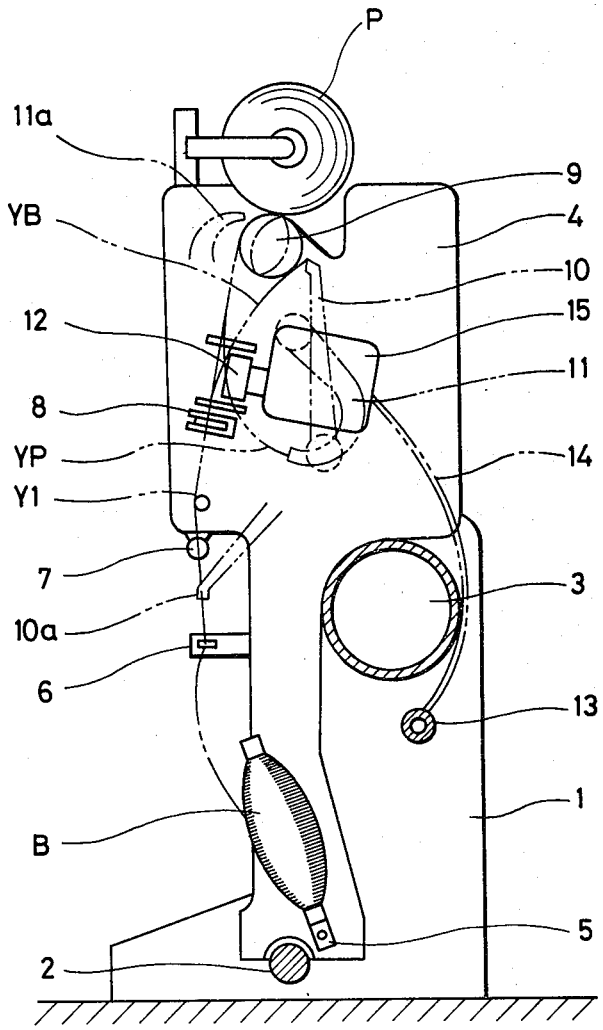
FIG. 1 is a schematic side view showing one embodiment of an automatic winder provided with the splicing apparatus of the present invention.

Referring to FIG. 1 diagrammatically illustrating an automatic winder to which the apparatus of the present invention is applied, a shaft or pipe 2 and a suction pipe 3 are laid out between every two adjacent side frames 1, and a winding unit 4 is turnably supported by the shaft 2 and while the automatic winder is being operated, the winding unit 4 is placed also on the suction pipe 3 and appropriately secured in this state. The pipe 3 is connected to a blower not shown in the drawings and a suction stream always acts on the pipe 3.

In this winding unit, rewinding of a yarn from a bobbin B to a package P is accomplished in the following manner. A yarn Y1 is taken out from the bobbin B on a peg 5 through a guide 6 and an appropriate tension is applied to the yarn by a tenser 7. The yarn is then passed through a detecting device 8 for performing detection of yarn unevenness such as slab, cutting of the yarn and detection of running of the yarn and is then wound on the package P rotated by a winding drum 9.

When yarn unevenness is detected by the detecting device 8, a cutter arranged in the vicinity of the detecting device is actuated to cut the yarn Y1 and stop the winding operation. Simultaneously, a first yarn guide suction arm 10 is actuated to guide a yarn YB on the side of the bobbin B to a splicing apparatus 12 located at a position apart from a normal yarn travel passage Y1 and a second yarn guide suction arm 11 is actuated to guide a yarn YP on the side of the package P to the splicing apparatus 12. When splicing is completed in the splicing apparatus 12, the rewinding operation is started again. The first and second yarn guide suction arms 10 and 11 are connected to the pipe 3 performing the sucking action by the air stream. Since a fluid such as compressed air is used for the splicing apparatus 12, a conduit 14 is connected between another pipe 13 and a splicing box 15 to supply a compressed fluid to the splicing apparatus 12 from the pipe 13.

Figure 2:
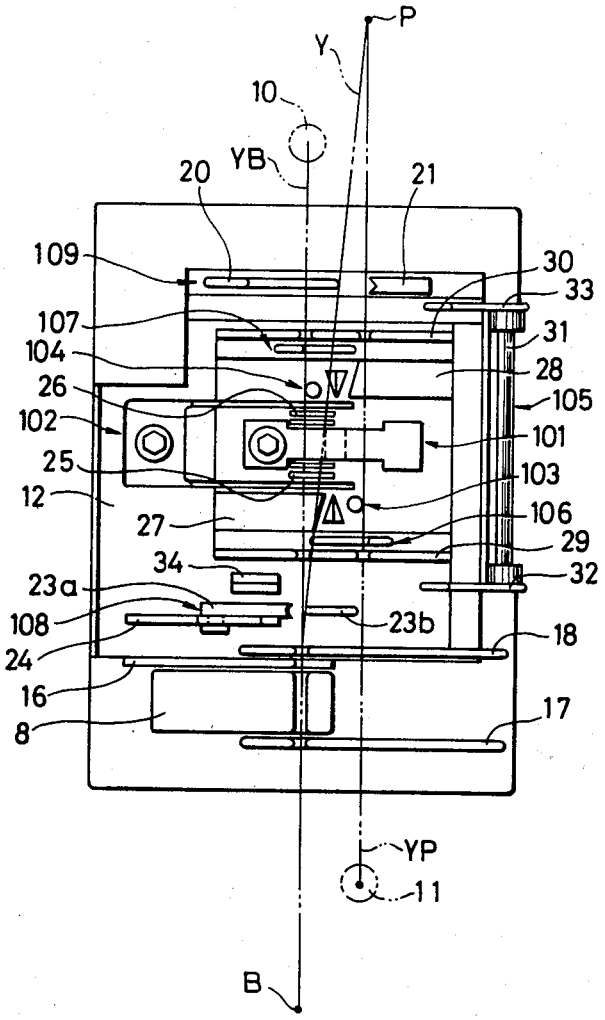
FIGS. 2 to 6, inclusive, are side and plan views showing the entire structure of the splicing apparatus of the present invention.
Figure 3:
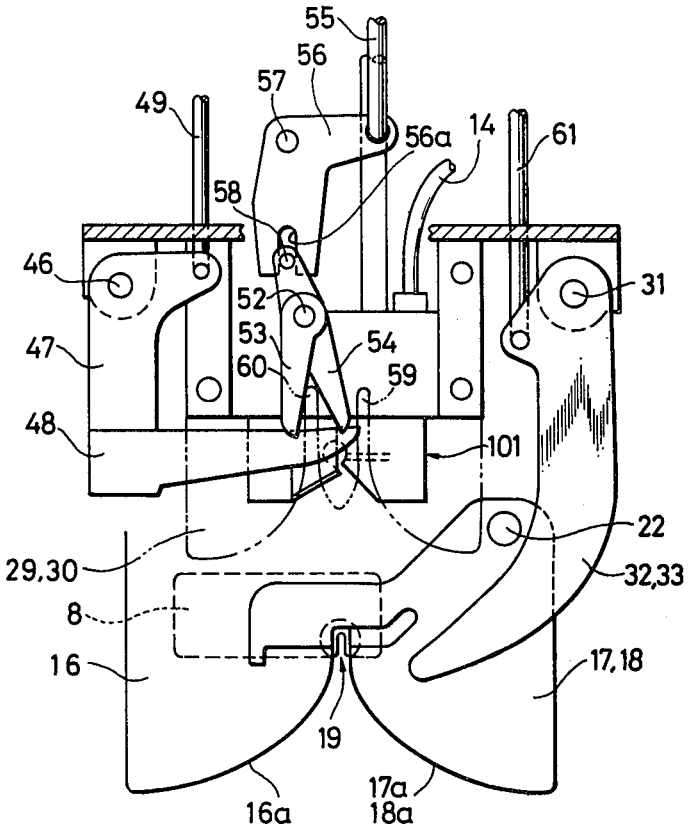

The entire structure of the splicing apparatus 12 is illustrated in detail in FIGS. 2 and 3. During the normal rewinding operation, the yarn Y is taken out from the bobbin B, is passed through the detecting device 8, a stationary guide 16 arranged on one end of the detecting device 8 and turnable guides 17 and 18 arranged on both the sides of the detecting device 8, travelled above the splicing apparatus 12 and wound on the package P.

The splicing apparatus 12 comprises as basic members a splicing member 101, a yarn pressing device 102, control nozzles 103 and 104, a yarn gathering lever 105, yarn cutting devices 106 and 107 and yarn clamping devices 108 and 109. The above-mentioned first and second suction arms 10 and 11 are turned and moved above the splicing apparatus 12 so that the suction openings on the top ends of the suction arms 10 and 11 intersect each other, and the first and second suction arms 10 and 11 suck the yarn ends YB and YP on the sides of the bobbin B and package P, move to the outside of the splicing apparatus 12 and stop there.

Figure 4:
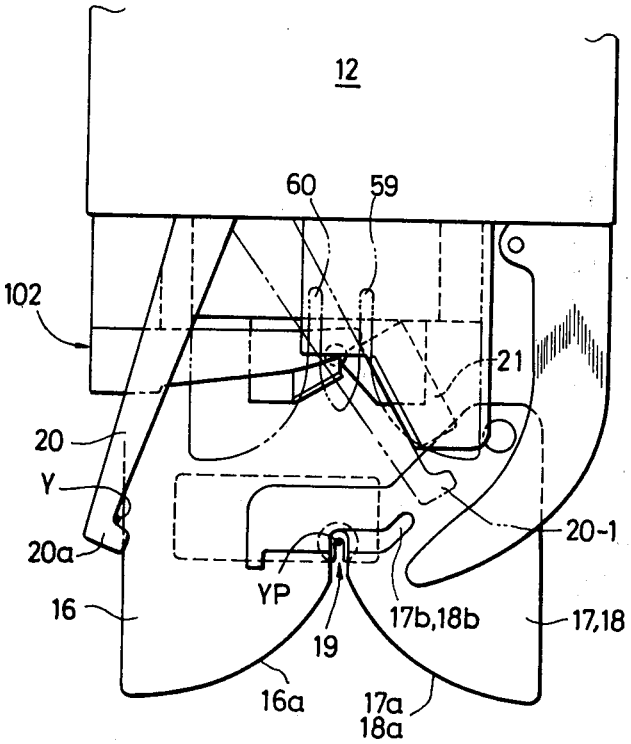

The first and second suction arms 10 and 11 are not simultaneously operated but they are operated with a certain time lag. More specifically, the yarn end YP on the side of the package P is turned to the outside of the splicing apparatus 12 by the suction arm 11 and substantially simultaneously with stoppage of the suction arm 11, a turning level 20 of the clamping device 109 on the side of the package P is turned in the counterclockwise direction to a chain line position 20-1 as shown in FIG. 4 by a control cam not shown in the drawings and is brought into abutting contact with a supporting block 21 secured at a predetermined position, whereby the turning lever 20 is stopped. At this time, the yarn Y is moved in the state where the yarn Y is caught on a hook **20*a* of the turning lever 20 and the yarn Y is gripped between the supporting block 21 and the turning lever 20**.

Figure 5:
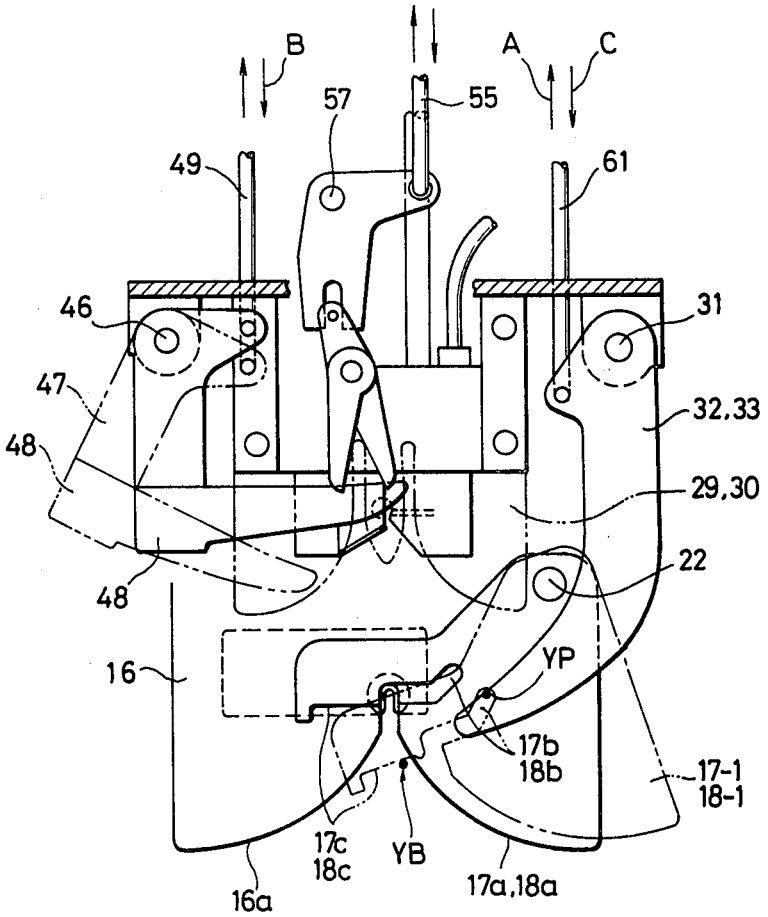

While the turning lever 20 is being operated, the yarn Y located on the stationary guide 16 and turning guides 17 and 18 is inserted in a guide groove 19 along inclined faces **16*a*, 17*a* and 18*a* of the guides 16, 17 and 18, and check of the absence or presence of the yarn Y or detection of erroneous suction of two or more of yarns by the suction arm 11 is performed by the detecting device 8 arranged at the same position as that of the guide groove 19. After confirmation of the presence of the yarn Y, the turning guides 17 and 18 are turned in the counterclockwise direction with a supporting shaft 22 being as the fulcrum as shown in FIG. 5 by a control cam not shown in the drawings. The yarn end YP is separated from the detecting device 8 and inserted into escape grooves 17*b* and 18*b* of the turning guides 17 and 18**.

Substantially simultaneously with the turning movement of the turning guides 17 and 18, the yarn end YB on the side of the bobbin B is sucked by the suction arm 10, and the suction arm 10 is turned in the direction of the suction arm 11 and is moved to the outside of the splicing apparatus 12 and stopped there. Substantially simultaneously with stopping of turning of the suction arm 10, a supporting plate **23*a* of the yarn clamping device 108 is turned along a guide plate 24 in the same direction as the turning direction of the turning lever 20 by a control cam not shown in the drawings in the state where the yarn is hung thereon, and the supporting plate 23*a* is stopped on abutting contact with a supporting block 23*b* secured at a predetermined position, whereby the yarn Y is gripped between the supporting plate 23*a* and the supporting block 23*b*. At this time, as shown in FIG. 5, the yarn YB is hung on hooks 12*c* and 18*b* formed in the vicinity of the top ends of the turning guides 17 and 18** by the turning movement of the guides 17 and 18, and checking in the detecting device 8 is performed after completion of the splicing operation.

The splicing member 101 is arranged substantially at the center of the splicing apparatus 12, and on both the sides of the splicing member 101, there are arranged yarn guide pins 25 and 26, pressing device 102, control nozzles 103 and 104 and yarn guides 27 and 28. Furthermore, there are arranged yarn cutting devices 106 and 107 and fork guides 29 and 30 in sequence. A yarn gathering lever 105 comprising a supporting shaft 31 and levers 32 and 33 turning with the shaft 31 being as the fulcrum is arranged in the side portion of the slicing member 101. After the detecting device 8 detects slab or other unevenness of the yarn Y to actuate a cutter not shown in the drawings to perform the cutting operation and the suction arms 10 and 11 are operated to guide the yarn ends YP and YB to the outside of the splicing apparatus 12, the yarn gathering lever 105 guides the yarn ends VP and YB toward the splicing apparatus 12. Incidentally, the turning range of the yarn gathering lever 105 is adjusted so that the yarn gathering lever 105 is stopped on abutting contact with a stopper 34 having a substantially V-shaped section, which is arranged between the fork guide 29 and the yarn clamping device 108.

Figure 7:
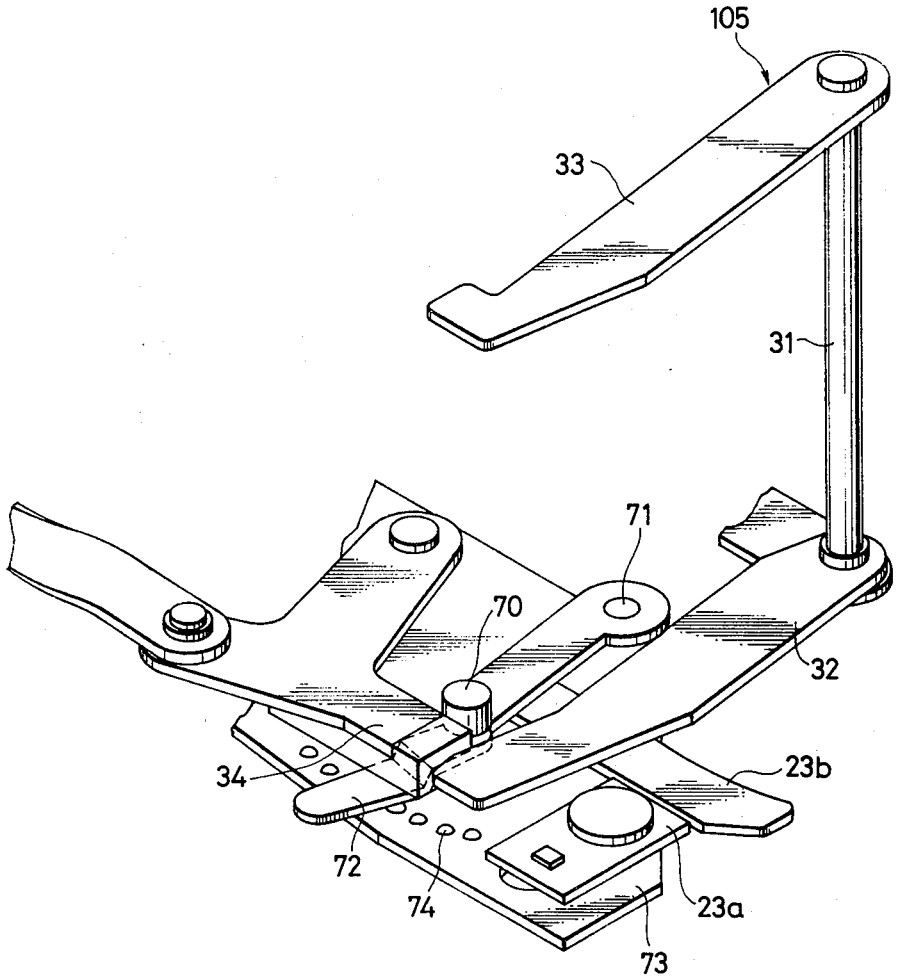
FIG. 7 is a perspective view showing the structure of the stopper for the yarn gathering lever.
Figure 9:
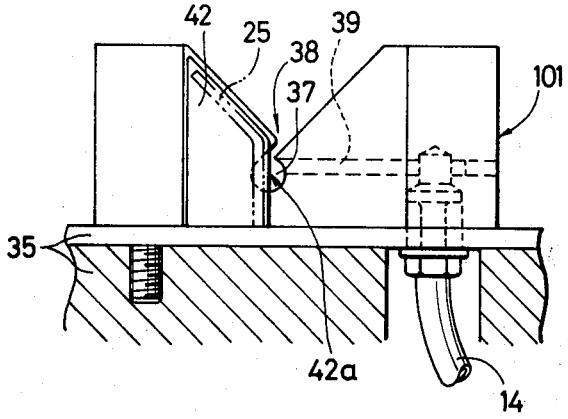
Figure 10:
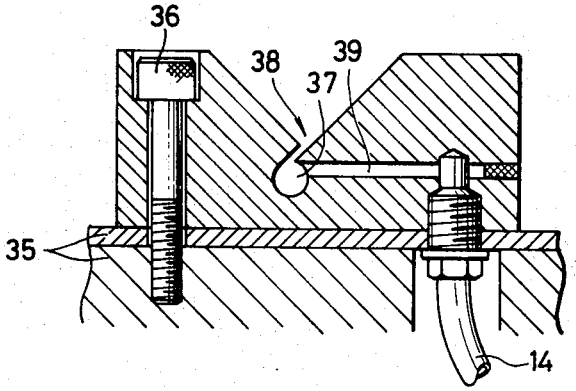
FIG. 10 is a sectional view of the splicing member.

The stopper 34 is movable between two positions. At the first position, the yarn gathering lever 105 is brought into abutting contact with the stopper 34, and the yarns YP and YB are guided to the splicing apparatus 12. As described hereinafter, the yarns YP and YB are then cut by the cutting devices 106 and 107 and are sucked to the control nozzles 103 and 104. Then, the stopper 34 is retreated to the second position, and the yarn gathering lever 105 is further turned and is stopped on abutting contact with another stopper 70 shown in FIG. 7. At this time, take-out of the yarn ends YP and YB sucked on the control nozzles 103 and 104 described hereinafter is performed. The stopper 70 is secured onto a lever 72 turnable around a shaft 71, and a claw projected from the lower face of the lever 72 becomes engaged with any of a pluraility of holes 74 formed on a base plate 71 so that the position of the stopper 70 can optionally be changed. Namely, if the claw is engaged with the intended hole 74, the quantity of the yarn ends YP and YB taken out from the control nozzle 103 and 104 can freely be adjusted.

The respective members and devices will now be described in detail one by one.

Referring to FIGS. 6 through 10, the splicing member 101 arranged substantially at the center of the splicing apparatus 12 is secured to a bracket 35 through a screw 36, and a cylindrical splicing hole 37 is formed substantially at the center of the splicing member 101 and a slit 38 for insertion of the yarn Y from the outside is formed entirely along the tangential direction of the splicing hole 37. Furthermore, a jet nozzle hole 39 opened to the splicing hole 37 in the tangential direction is formed. In the present embodiment, the cylindrical nozzle hole 39 is formed substantially at the center of the splicing hole 37 in the longitudinal direction thereof. However, instead of this cylindrical nozzle hole 39, there may be formed a laterally expanded nozzle hole 39 having an ellipsoidal, rectangular or long-groove-like sectional shape or a plurality of nozzle holes 39. When the yarn to be spliced is thick, for example, when a yarn having a count number of 10 or more is spliced, especially good results can be obtained by using a nozzle hole having a laterally expanded section.

The splicing member 101 include control plates 42 and 43 screwed through spacers 40 and 41, and the control plates 42 and 43 are positioned at such positions that certain side edges 42*a* and 43*a* of the control plates 42 and 43 traverse a part of the opening of the splicing hole 37. In the present embodiment, the side edges 42*a* and 43*a* are present substantially on the diameter line of the opening of the splicing hole 37. However, if the positions of the control plates 42 and 43 are adjustable, it is possible to change the positions of the side edges 42*a* and 43*a*.

The control plates 42 and 43, together with a pressing lever 48 described hereinafter, perform positioning of two yarn ends to be inserted into the splicing hole 37 so that initial entanglement of both the yarn ends on jetting of air can be guaranteed and simultaneously, the control plates 42 and 43 control the quantity of air jetted from the openings on both the ends of the splicing hole 37 to prevent fly-out of the yarn ends and produce appropriate turning streams providing a beautiful knot. The spacers 40 and 41 increase the quantity of the compressed fluid which impinges against the walls of the control plates 42 and 43 and flows toward the slit 38, whereby the yarn end Y is prevented from flying out from the slit 38. Furthermore, by provision of the spacers 40 and 41, open spaces are formed between the walls 45 of the splicing member 101 and the control plates 42 and 43 and the quantity of the fluid flowing out from the slit 38 is controlled by these open spaces. Incidentally, the fluid is supplied to the jet nozzle hole 39 through the above-mentioned conduit 14.

Figure 11:
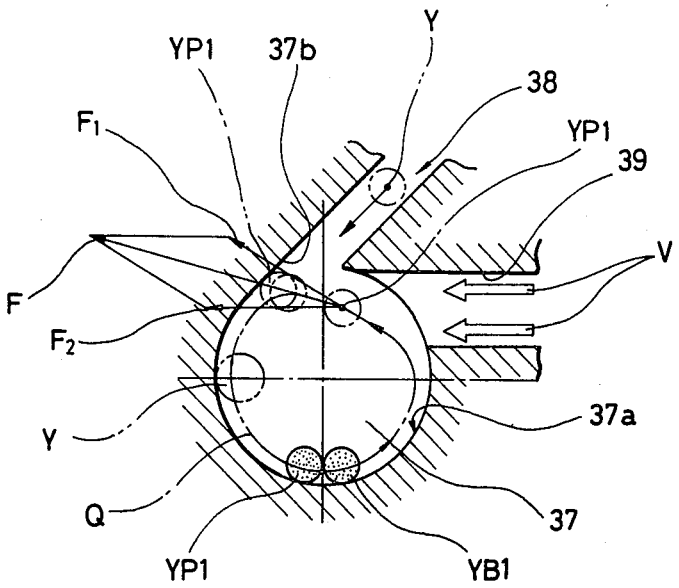
FIGS. 11 and 12 illustrate modes of the splicing operation.
Figure 12A:
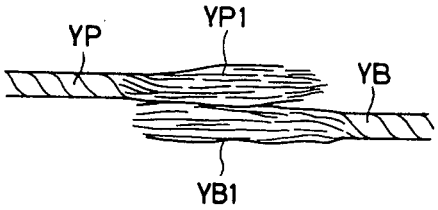
Figure 12B:
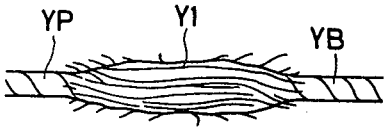
Figure 12C:
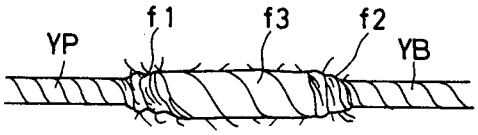
Figure 12D:
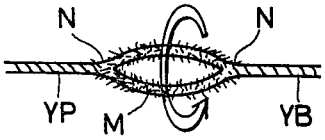

The step of forming a joint by splicing is illustrated in FIGS. 11 and 12. The yarn end YB on the side of the bobbin B and the yarn end YP on the side of the package P, which are to be spliced together, are inserted from the slit 38 opened to one end of the splicing hole 37 and placed in the state kept in contact with the inner circumferential face 37*a* of the splicing hole 37 at the position substantially confronting the opening of the slit 38 of the splicing hole 37. If a compressed fluid V is jetted within the splicing hole 37 in this state, the fluid V flows along the inner circumferential face 37*a* of the splicing hole 37, and when the fluid flows along about $\frac{1}{2}$ of the circumference in the splicing hole 37, the fluid catches both the yarn ends YB1 and YP1 and continues the turning movement.

When the fluid further makes substantially one round, the turning fluid F1 joins with a fluid F2 subsequently jetted and a joined flow F of the turning fluid F1 and jetted fluid F2 is formed.

At this time, the yarn ends YB1 and YP1 to be spliced are moved along locus Q of the above-mentioned fluid, and when the yarn ends YB1 and YP1 arrive at the point where the turning fluid F1 joins with the jetted fluid F2, the yarn end YB1 is first caused to abut against the inner circumference 37*b* of the splicing hole 37 slightly inwardly of the opening of the slit 38 and the yarn end YP1 is caused to impinge against the yarn end YB1. At this point, both the yarn ends YB1 and YP1 are entangled and integrated with each other. This operation of entangling and integrating both the yarn ends with each other should be performed at the initial stage of the turning movement of the yarn ends. The reason is that as the yarn end Y1 formed by integration of the yarn ends YB1 and YP1 is turned, twists are given to the yarn end Y1 and entanglement is caused on both the ends of the twisted portion and the integration of the yarn ends becomes difficult after the yarn ends have been rotated and turned for a certain time.

More specifically, before the yarn ends YB1 an YP1 to be spliced are guided into the splicing hole 37, the yarn ends YB1 and YP1 are untwisted by the splicing control nozzles 103 and 104 described hereinafter as shown in FIG. 12-*a* and all the fibers are arranged substantially in parallel to one another. Then, as shown in FIG. 12-*b*, both the yarn ends YP1 and YB1 are integrated at the point where the turning fluid flow F1 joins with the fluid flow F2 jetted from the jet nozzle 39. Then, the fibers of both the yarn ends are tightly entangled with one another by the action of the turning fluid stream and twists f3 are given between both the entangled portions f1 and f2, as shown in FIG. 12-*c*.

When the jetted fluid V is applied to the yarn ends YP1 and YB1, as shown in FIG. 12-*d*, a balloon M is formed, and if the rotation number of the balloon is increased, the respective fibers in the vicinity of the balloon neck N are made untwisted and unentangled and yarn breakage is readily caused in this portion. Accordingly, the rotation number of the balloon is controlled to a level suitable for the splicing operation by the above-mentioned balloon control plates 42 and 43.

Referring to FIGS. 2 and 3, the pressing device 102 arranged on both the sides of the splicing member 101 co-operates with turning of the yarn gathering lever 105 at the splicing step to take out the yarn ends YP1 and YB1 untwisted by the splicing control nozzles 103 and 104 and set them within the splicing hole 37 and simultaneously, the pressing device 102 controls the positions of both the yarns YP and YB. In the pressing device 102, a pressing plate 48 is screwed to a turning lever 47 turnable with a supporting shaft 46 fixed at a constant position being as the fulcrum and if a rod 49 is operated by a control cam not shown in the drawings, the pressing plate 48 is turned as shown in FIG. 5.

Figure 13:
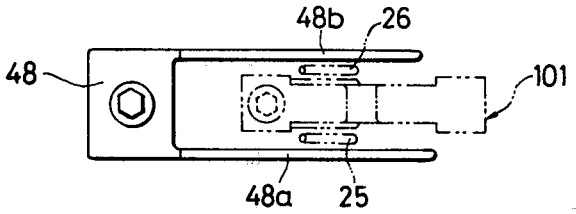
FIGS. 13 and 14 are plan and side views illustrating in detail the yarn pressing plate.
Figure 14:
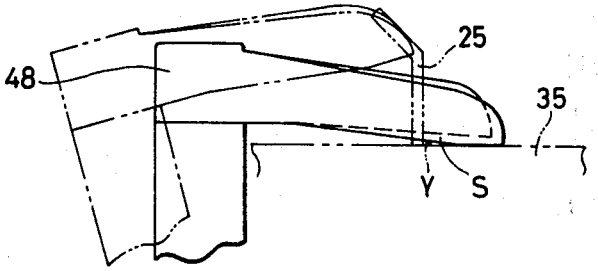

The yarn pressing plate 48 is illustrated in detail in FIGS. 13 and 14. The pressing plate 48 has forked pieces 48*a* and 48*b* extended to the top end, and these forked pieces are different to some extent in the shape. When the pressing plate 48 is turned and one forked piece 48*a* falls in abutting contact with the face of the bracket 35 to press the yarn Y among the top face of the bracket 35, the yarn guide pin 25 and the forked piece 48*a*, a certain space S allowing passage of the yarn Y is formed among the other forked piece 48*b*, the top face of the bracket 35 and the yarn guide pin 26, whereby the position control is effected only in the direction traversing the yarn Y at a right angle.

The yarn pressing action of the forked piece 48*a* of the pressing plate 48 is performed to prevent return of twists caused by the action of a balloon formed on the yarn ends YB1 and YP1 by the action of the compressed fluid as described hereinbefore.

Accordingly, the degree of this pressing action is controlled to such an extent that twists on the yarn Y are not released by the action of the balloon. If this pressing action is too strong, fluffs are formed and no good results can be obtained. Since the other yarn Y is rotated in the twisting direction by the action of the balloon, this yarn need not particularly be held and it is sufficient if this yarn Y is pressed only to such a degree that the position thereof is controlled.

Figure 15:
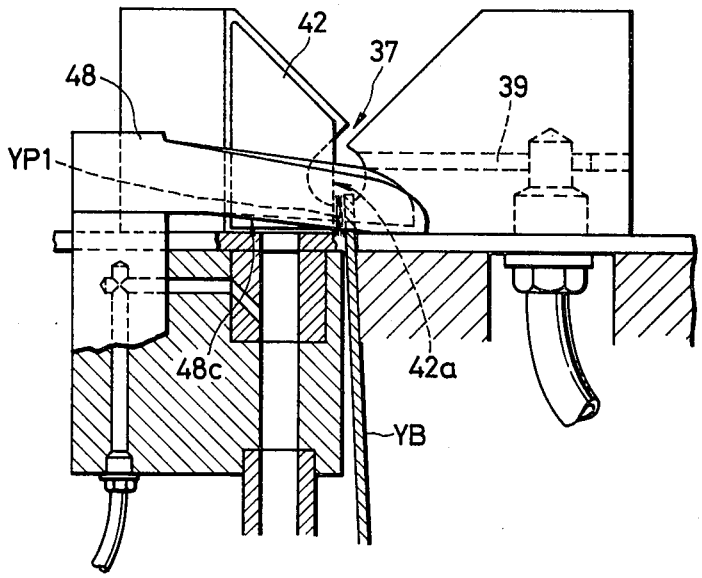
FIG. 15 is a plan view showing the state of positioning of yarn ends by the control plates and yarn pressing plate.

Positioning of the lapped portion of the yarn ends is performed by the turning movement of the yarn pressing plate 48 in co-operation with the above-mentioned control plates 42 and 43. More specifically, as shown in FIG. 15, the side edge of the pressing plate 48 intersects the specific side edges 42*a* and 43*a* of the control plates 42 and 43 located at positions traversing a part of the opening of the splicing hole 37, and by dint of this arrangement, both the yarn ends YB1 and YP1 are positioned so that they fall in contact with the inner circumferential wall face of the splicing hole 37 in the state where they are kept in contact with each other, whereby initial entanglement can be guaranteeed on jetting of air. At this time, the completely free top portions of both the yarn ends are simultaneously bent.

Figure 16:
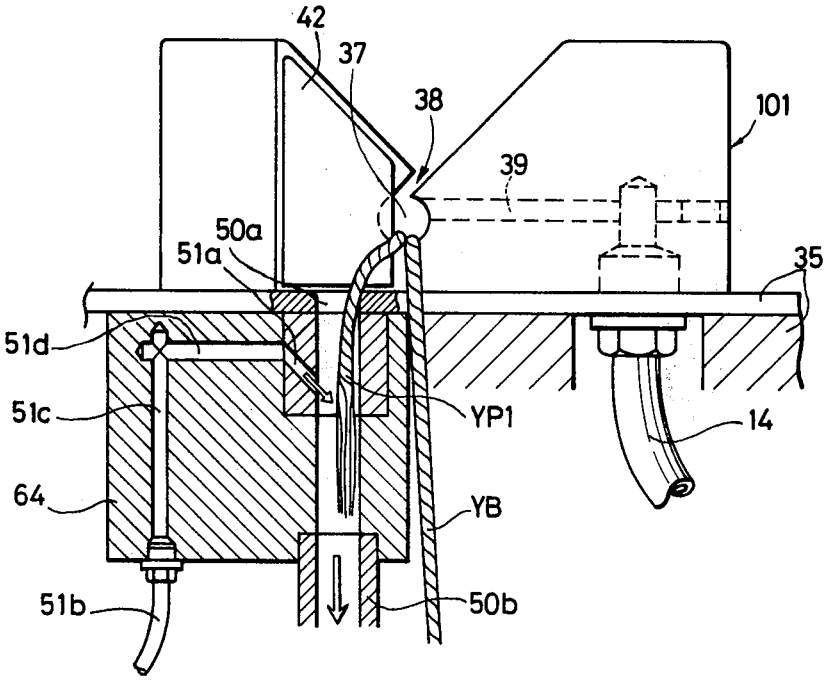
FIGS. 16 to 19, inclusive, are entire or partial sectional views showing the control nozzles.

As shown in FIG. 16, a nozzle hole 50*a* for untwisting the yarn ends YB1 and YP1 is formed on the yarn control nozzles 103 and 104 arranged on both the sides of the pressing device 102, and the yarn end YB1 on the side of the bobbin B and the yarn end YP1 on the side of the package P, which are to be spliced together, are guided into this nozzle hole 50*a* through the yarn splicing hole 37. Introduction of the yarn ends YB1 and YP1 is accomplished by the sucking action of the above-mentioned suction pipe 3 through a flexible pipe 50*b*. When the yarn end YP1 is guided into the nozzle hole 50*a*, a fluid is jetted from a jet nozzle 51*a* opened obliquely to the nozzle hole 50*a* to untwist the yarn end YP1 and arrange the respective fibers in parallel to one another.

Figure 17:
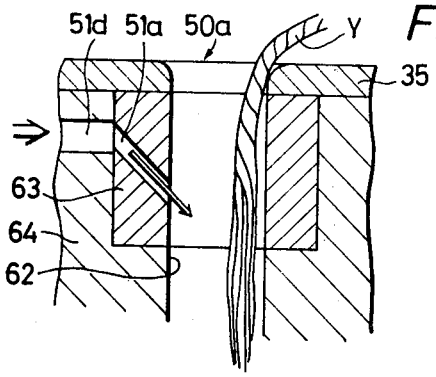
Figure 20A:
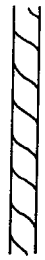
FIG. 20 is a diagram showing the twisting direction of the yarn.
Figure 20B:
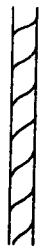
Figure 18:
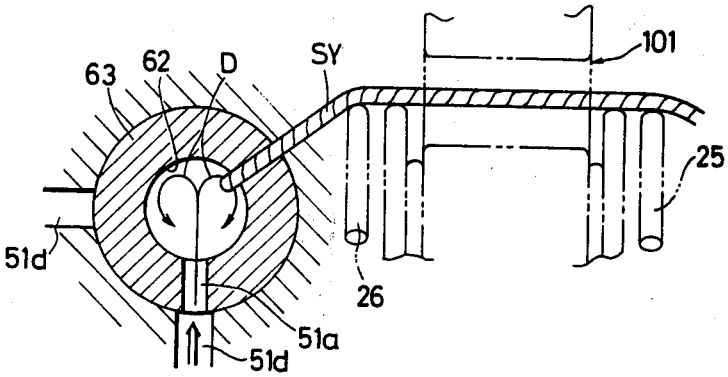
Figure 19:
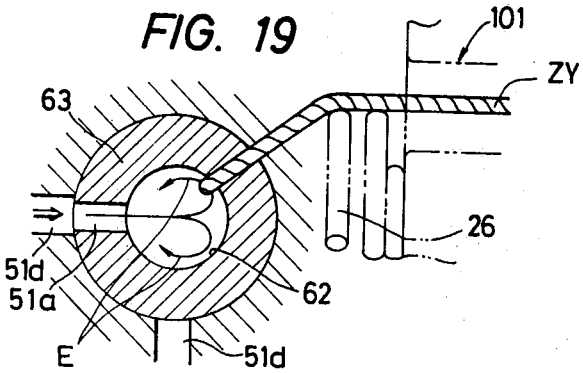

Referring to FIGS. 17 through 19 illustrating the nozzle hole 50*a* in detail, the yarn Y having the top portion not restricted but kept free, which is inserted into a suction hole 62 is untwisted by a compressed fluid jetted from the jet nozzle 51*a* opened obliquely to a sleeve 63. However, since the twists given to the yarn Y include Z twists and S twists as shown in FIGS. 20-*a* and 20-*b* and the twisting directions of these two kinds of twists are opposite to each other, the jetting direction of the jet nozzle 51*a* should be adjusted appropriately according to the twisting direction of the twists on the yarn Y. More specifically, in case of an S-twisted yarn SY, the turning flow of the fluid jetted from the jet nozzle 51*a* should be caused in the direction of arrow D in FIG. 18 so as to untwist the yarn SY, and in case of a Z-twisted yarn ZY, the turning flow should be caused to act in the direction of arrow E in FIG. 19, that is, in the direction opposite to the direction in case of the S-twisted yarn. In order to realize this feature, a communication hole 51*d* communicated wit the jet nozzle 51*a* of the sleeve 63 is formed on a supporting block 64 rotatably supporting the sleeve 63 with a deviation of about 90°, and by rotating the sleeve 63 by about 90°, either S twists or Z twists can be released.

There may be adopted a modification in which the jet nozzle 51*a* is formed tangentially to the suction hole 62 so that a turning fluid flow acting in the direction opposite to the twisting direction on the yarn is formed. Moreover, there may be adopted another modification in which the jet nozzle 51*a* as described above is not formed but a spiral groove or spiral vane is formed on the inner wall of the suction hole 62 and a turning flow is produced by the sucking action of the flexible pipe 50*b*. In this modification, the spiral direction of the spiral groove or spiral vane is set according to the twisting direction of the yarn Y.

Incidentally, the above-mentioned nozzle hole 50*a* is effective for promoting untwisting of the yarn Y, but in principle, the intended effect can be attained only by the sucking action of the flexible pipe 50*b* not causing a turning flow. The fluid is supplied from the pipe 13 connected through the above-mentioned conduit 14 via a conduit 51*b* and communication holes 51*c* and 51*d*, and the nozzle hole 50*a* of the control nozzles 103 and 104 has similar structure and function to those described above. Incidentally, in the foregoing embodiment, the fluid jetting action of the jet nozzle 51*a* and the sucking action of the flexible pipe 50*b* are simultaneously performed. However, there may be adopted a modification in which only the compressed fluid jetting action of the jet nozzle 51*a* is performed.

Referring to FIGS. 2 and 3, the cutting devices 106 and 107 have a scissor-like shape, and in each cutting device, a movable blade 54 is turned with a stationary pin 52 being as the fulcrum so that the movable blade 54 intersects a stationary blade 53, whereby the yarn Y is cut. When a rod 55 is actuated by a control cam not shown in the drawings, a bifurcate lever 56 is turned in the clockwise or counterclockwise direction with a shaft 57 being as the fulcrum, and the fork-like portion 56*a* of the lever 56 moves a supporting pin 58 on the other end of the movable blade 54, whereby the movable blade 54 is operated.

Fork guides 29 and 30 are arranged outwardly of the yarn cutting devices 106 and 107, and guide grooves 59 and 60 are formed on the fork guides 29 and 30, respectively.

The yarn gathering lever 105 arranged in the side portion of the splicing apparatus 12 is turned in the clockwise direction with a shaft 31 being as the fulcrum to introduce the yarns YP and YB into guide grooves 59 and 60 when a rod 61 is operated by a control cam not shown in the drawings.

In operation of the splicing apparatus having the above-mentioned structure will now be described.

Referring to FIG. 1, when the detecting device 8 detecting breakage of the yarn being rewound or the absence of the yarn on a bobbin detects that the yarn does not travel, the drum 9 is stopped, and simultaneously, a one-way clutch not shown in the drawings is actuated and the splicing operation is performed by various control cams arranged on a shaft rotated through said clutch or by various control cams cooperating with said shaft.

At first, the first and second yarn guide suction arms sucking the yarn ends are turned and moved from the chain line position 10*a* and 11*a* shown in FIG. 1, and they pass above the splicing apparatus 12 in such a manner that the yarn YB on the side of the bobbin B and the yarn YP on the side of the package P intersect each other. Then, the suction arms are guided to the outside of the splicing apparatus 12 and stopped there.

As pointed out hereinbefore, the first and second suction arms are not simultaneously performed, but at first, the yarn YP on the side of the package P is sucked by the suction arm 11 is turned to the outside of the splicing apparatus 12 and stopped there, and after passage of a predetermined time, the yarn YB on the side of the bobbin B is sucked by the suction arm 10 and is turned to the outside of the splicing apparatus 12 and stopped there. After passage of a predetermined time, the yarn YB on the side of the bobbin YB is sucked by the suction arm 10 and is turned to the outside of the splicing apparatus 12 and stopped there.

During the predetermined time from the point of actuation of the second suction arm 11 to the point of actuation of the first suction arm 10, as shown in FIGS. 4 and 5, the turning lever 20 of the clamping device on the side of the package P is operated to grip the yarn YP between the turning lever 20 and the supporting block 21, and simultaneously, the yarn YP is introduced into the guide groove 19 of the stationary guide 16 and turning guides 17 and 18 arranged in the vicinity of the detecting device 8 and detection is performed by the detecting device 8. Then, the turning guides 17 and 8 are turned to the chain line positions 17-1 and 18-1 with the shaft 22 being as the fulcrum to separate the yarn YP from the detecting device 8 and insert the yarn UP into the escape grooves 17*b* and 18*b*.

Figure 6:
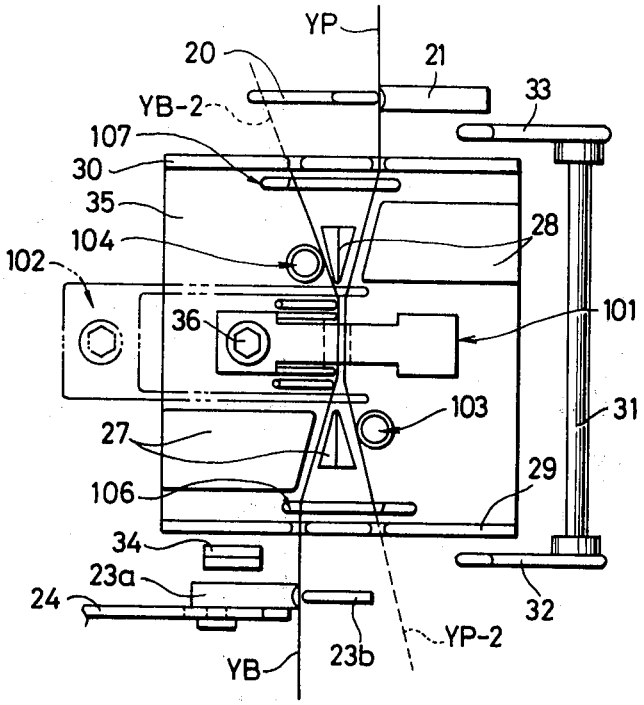
Figure 8:
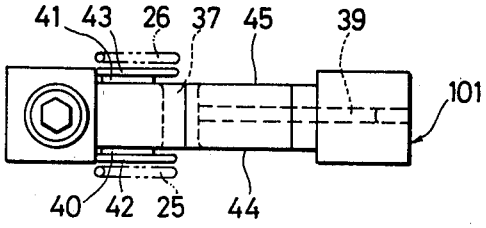
FIGS. 8 and 9 are plan and side views of the splicing member, respectively.

Then, the first suction arm 10 sucks the yarn YB on the side of the bobbin B, and is turned to the outside of the splicing apparatus 12 and stopped there. At this time the yarn YB is passed through the hook portions 17*c* and 18*c* of the turning guides 17 and 18 and is gripped between the supporting plate 23*a* and supporting block 23*b* of the clamping device 108 as shown in FIG. 6. Accordingly, detection of the yarn YB on the side of the bobbin B by the detecting device 8 is not performed before the splicing operation but is performed after completion of the splicing operation.

When the above-mentioned operations of the first and second suction arms 10 and 11 are completed, the levers 32 and 33 of the yarn gathering lever 105 shown in FIGS. 2 through 6 are turned with the shaft 31 being as the fulcrum and both the yarns YB and YP are guided into the guide grooves 59 and 60 of the fork guides 29 and 30, respectively and are inserted into the splicing hole 37 of the splicing member 101 through the slit 38.

Figure 21:
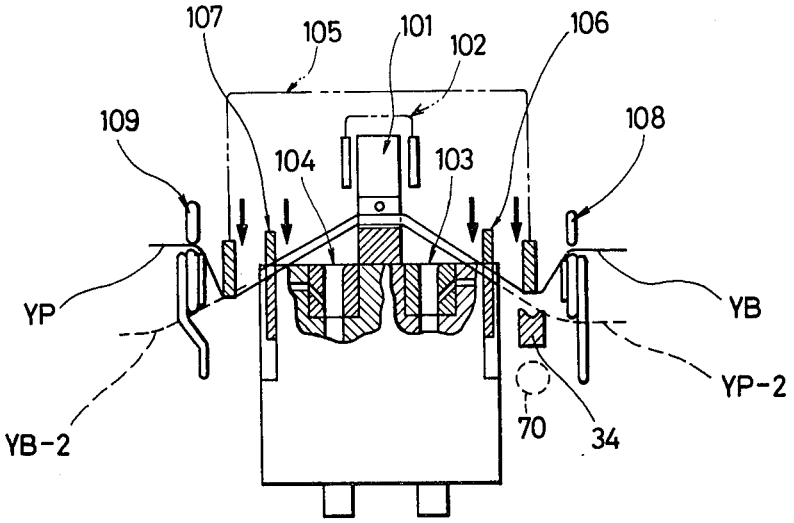
FIGS. 21 to 24, inclusive, are diagrams illustrating the splicing operation.

Then, the yarns YB and YP are cut at positions YB-2 and YP-2 separated by predetermined distances from the clamping devices 108 and 109 by the cutting devices 108 and 109. More specifically, referring to FIG. 21, both the yarns YB and YP are gripped by the clamping devices 108 and 109, and the yarn gathering lever 105 is moved in the direction indicated by an arrow and the yarn cutting operation is performed in the state where the lever 105 abuts against the stopper 34.

Incidentally, while the yarn gathering lever 105 and cutting devices 106 and 107 are operated, the yarn pressing device 102 is kept turned in the clockwise direction with the shaft 46 being as the fulcrum by the operation (in the direction of arrow B) of the rod 49 as shown in FIG. 5.

Figure 22:
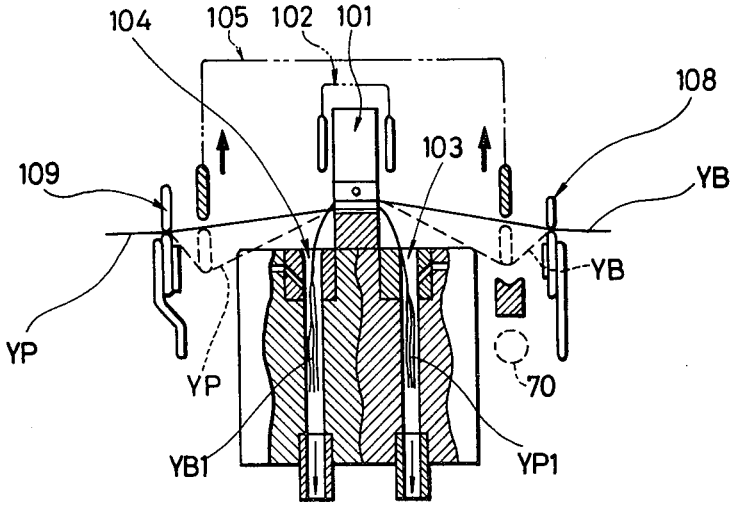

Then, as shown in FIG. 22, the yarn ends YB1 and YP1 are sucked by the control nozzles 103 and 104, and simultaneously or subsequently, the yarn gathering lever 105 is turned in the counterclockwise direction with the shaft 31 being as the fulcrum that is, in the direction separating from the yarn, by the operation (in the direction of arrow C) of the rod 61 as shown in FIG. 5, and the yarn gathering lever 105 thus separates from the yarn Y. At this time, as shown in FIG. 16, the yarn ends YB1 and YP1 are sucked into the nozzle hole 50*a* by the sucking action of the suction pipe 3 connected through the flexible pipes 50*b* and the yarn ends YB1 and YP1 are untwisted to a state suitable for the splicing operation by a compressed fluid supplied from the pipe 13 and jetted from the jet nozzle 51*a* through the conduit 51*b* and communicating holes 51*c* and 51*d*.

It is preferred that the sucking action of the control nozzles 103 and 104 be initiated just before the yarn is cut by the cutting devices 106 and 107. More specifically, when the yarn Y is cut, since a tension is given to the yarn by the sucking action of the suction arms 10 and 11, the yarn ends YB1 and YP1 are scattered by the cutting operation and separated from the positions of the control nozzles, with the result that it sometimes happens that sucking of the yarn ends YB1 and YP1 by the control nozzles 103 and 104 is not performed. Accordingly, although in principle it is permissible that the sucking operation of the control nozzles 103 and 104 may be performed simultaneously with or subsequently to the cutting operation, it is preferred, as pointed out thereinbefore, that the sucking operation be performed just before the cutting operation. Supply of the fluid to the control nozzles 103 and 104 is accomplished by changeover of valves by solenoids not shown in the drawings.

Figure 23:
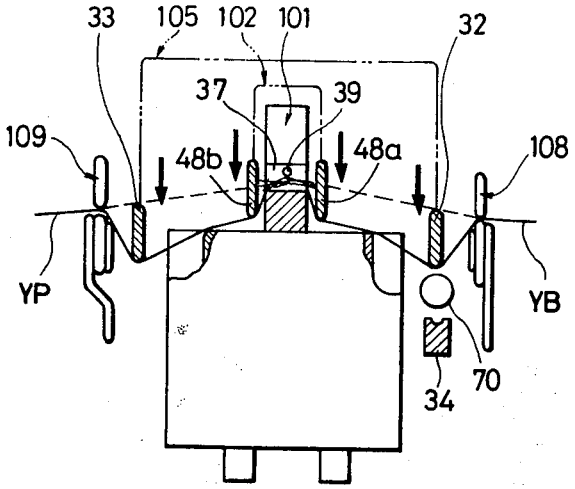

The yarn ends YB1 and YP1 are thus untwisted to a state for the splicing operation by the control nozzles 103 and 104, and the sucking operation of the control nozzles 103 and 104 is stopped. Simultaneously or subsequently, as shown in FIG. 23, the yarn gathering lever 103 is operated again. At t this point, the stopper 34 is retreated from the front position to the second position and instead, the second stopper 70 is located at the front position. The yarn gathering lever 105 is turned to the position abutting against the face of the bracket 35 as shown in FIGS. 13 and 14 while guiding the yarn ends YB1 and YP1, and the yarn Y is gripped by one fork of the pressing plate 48, that is, the fork 48*a* on the side where the yarn Y is untwisted by the compressed fluid jetted from the jet nozzle hole 39 of the splicing member 101, to such an extent that excessive untwisting of the yarn Y is inhibited. On the other hand, since the compressed fluid acts in the twisting direction on the other side, the yarn Y need not particularly be gripped by the fork 48*b* located on the other side and only such a pressing action as controlling the position of the yarn is sufficient on the side of the fork 48*b*.

Figure 24:
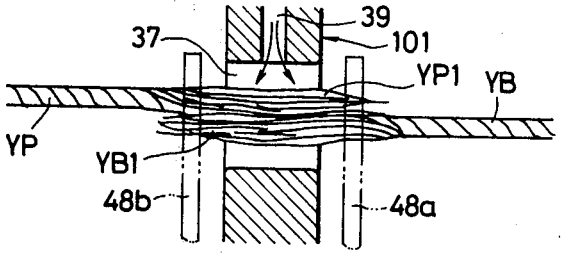

The yarn ends YB1 and YP1 inserted in the nozzle hole 50*a* of the control nozzles 103 and 104 by the operations of the yarn gathering lever 105 and the yarn pressing device 102 are gathered into the splicing hole 37 of the splicing member 101, and they are positioned and set in the state where the top portions to be spliced are lapped together as shown in FIG. 24. At this time, the length of the joint to be formed by the splicing operation is set by the turning distances of the yarn gathering lever 105 and the yarn pressing device 102. In other words, the turning distances of the yarn gathering lever 105 and the yarn pressing device 102 are adjusted according to the count number of the yarn. The positions for pressing the yarn ends YB1 and YP1 by the pressing plates 48*a* and 48*b* are not particularly critical, but from the viewpoint of the stability, it is preferred that the pressing positions be in the vicinity of the lapped top portion of the yarn ends YB1 and YP1.

The yarn ends YB1 and YP1 are taken out from the control nozzles 103 and 104 by the turning movement of the yarn gathering lever 105 while they are regulated by the control plates 42 and 43 located on both the sides of the splicing hole 37, and as shown in FIG. 15, the yarn ends YB1 and YP1 are positioned on the inner circumferential face of the splicing hole 37 by the side edges 42*a* and 43*a* of the control plates 42 and 43 and the side edge 48*c* of the yarn pressing plate 48 and they are set within the splicing hole 37 in the state where both the yarn ends to be spliced are lapped together while having contact with each other.

Figure 25:
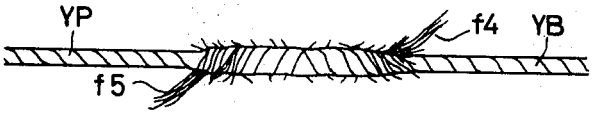
FIG. 25 is a diagram showing the structure of the joint formed by the conventional technique.
Figure 26:
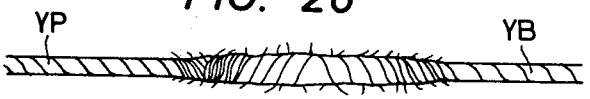
FIG. 26 is a diagram showing the structure of the joint formed by the splicing apparatus of the present invention.

In the state where the yarn ends YB1 and YP1 are thus set within the splicing hole 37, by the action of the compressed fluid jetted from the jet nozzle hole 39, the splicing operation is performed according to procedures described in detail hereinbefore with reference to FIGS. 11 and 12. At this step, fibers of both the yarn ends contacted with each other by the fluid jetted from the fluid jet nozzle 39 are integrated before they are turned, and while the integrated yarn ends are then turned, twists are given to the integrated portion and entanglement is caused on both the sides of the twisted portion. Since the sucking action of the control nozzles has already been stopped, no resistance is imposed on the untwisted top portions of the yarn ends, and therefore, the splicing operation can be performed while completely preventing formation of a horny projection. More specifically, according to the conventional technique, horny projections f4 and f5 are inevitably formed on both the ends of the joint by influences of control nozzles as shown in FIG. 25, whereas according to the present invention, fibers are completely entangled and wrapped in the joint as shown in FIG. 26. When the splicing operation is completed, the yarn gathering lever 105 and the yarn pressing device 102 separate from the yarn Y, and the yarn Y is returned into the normal rewinding state through the slit 38.

What is claimed is:

1. A splicing apparatus for spun yarns including a splicing member arranged at the center of the splicing apparatus and having a cylindrical splicing hole formed substantially at the center of the splicing member, a slit for insertion of the yarns into the splicing hole and a jet nozzle for jetting a compressed fluid into the splicing hole and opened to the splicing hole in the tangential direction, characterized in that control plates are located on both the outer sides of the splicing hole at such positions that certain side edges of the control plates respectively traverse a part of an opening of the splicing hole.

2. A splicing apparatus as claimed in claim 1, wherein said splicing apparatus further includes a swingable yarn pressing device comprising a pressing plate having two forked pieces, said pressing plate being screwed to a turning lever turntable with a supporting shaft fixed at a constant position being as the fulcrum and said forked pieces being able to be located on the outer sides of the control plates.

3. A splicing apparatus as claimed in claim 2, wherein said forked pieces of the pressing plate are different to some extent in the shape, said forked piece having a side edge pressing at least one of two yarns to be spliced together and intersecting the side edges of the control plate.

4. A splicing apparatus as claimed 1 or 2, wherein said control plates are screwed to the splicing member through spaces respectively on both the sides thereof to form an open spaces between the walls of the splicing member and the control plates and to controll the quantity of the fluid flowing out from the slit.

5. A splicing apparatus as claimed in claim 2, wherein yarn guide pins are provided between the yarn control plate and the forked pieces of the yarn pressing plate at the both side of the yarn splicing member.

6. A splicing apparatus as claimed in any one of claims 1–3 and 5, wherein the splicing apparatus further includes yarn end control nozzles, yarn cutting devices, a yarn gathering lever having a supporting shaft and levers turning with a shaft as the fulcrum and yarn clamping devices, which are arranged insequence on both sides of the splicing member.

* * * * *